US011700486B2

(12) United States Patent
Schreibman

(10) Patent No.: US 11,700,486 B2
(45) Date of Patent: Jul. 11, 2023

(54) AUDIBLE HOWLING CONTROL SYSTEMS AND METHODS

(71) Applicant: GM GLOBAL TECHNOLOGY OPERATIONS LLC, Detroit, MI (US)

(72) Inventor: Amos Schreibman, Hod Hasharon (IL)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 15 days.

(21) Appl. No.: 17/394,237

(22) Filed: Aug. 4, 2021

(65) Prior Publication Data

US 2023/0044336 A1 Feb. 9, 2023

(51) Int. Cl.

| | |
|---|---|
| ***H04R 3/02*** | (2006.01) |
| ***G10L 21/0232*** | (2013.01) |
| ***G10L 21/0216*** | (2013.01) |
| ***G10L 21/0208*** | (2013.01) |

(52) U.S. Cl.

CPC ..... *H04R 3/02* (2013.01); *G10L 21/0232* (2013.01); *G10L 2021/02082* (2013.01); *G10L 2021/02163* (2013.01)

(58) Field of Classification Search

None

See application file for complete search history.

(56) References Cited

U.S. PATENT DOCUMENTS

| | | | | |
|---|---|---|---|---|
| 6,442,280 | B1 * | 8/2002 | Ito | H04R 3/02 381/83 |
| 2006/0227978 | A1 * | 10/2006 | Truong | H04M 9/082 381/66 |
| 2013/0156205 | A1 * | 6/2013 | Ura | H04R 3/02 381/56 |
| 2018/0068672 | A1 * | 3/2018 | Reuter | H04R 27/00 |

* cited by examiner

*Primary Examiner* — Kenny H Truong

(57) ABSTRACT

An audio system includes: a speaker; a microphone that generates a microphone signal based on sound output from the speaker; a mixer module configured to generate a mixed signal by mixing the microphone signal with an audio signal; a filter module configured to filter the mixed signal to produce a filtered signal and to apply the filtered signal to the speaker; and a detector module configured to determine a howling frequency in the microphone signal attributable to sound output from the speaker, where the filter module is configured to decrease a magnitude of the filtered signal at the howling frequency.

18 Claims, 12 Drawing Sheets

AUDIBLE HOWLING CONTROL SYSTEMS AND METHODS

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to audio systems and more particularly to systems and methods for minimizing howling of audio systems.

Vehicles include one or more torque producing devices, such as an internal combustion engine and/or one or more electric motors. A passenger of a vehicle rides within a passenger cabin (or passenger compartment) of the vehicle.

Various types of systems may include both a microphone and one or more speakers, such as a vehicle. Howling is a phenomenon heard in live musical performances, public announcement/address (PA) systems, and other types of systems that include both a microphone and one or more speakers. Howling is an unpleasant sound that occurs when there is acoustic coupling between a microphone and a loudspeaker system. Howling may refer to the situation where output from the speakers is fed back into the system via the microphone, which causes further output to the speaker, etc.

SUMMARY

In a feature, an audio system includes: a speaker; a microphone that generates a microphone signal based on sound output from the speaker; a mixer module configured to generate a mixed signal by mixing the microphone signal with an audio signal; a filter module configured to filter the mixed signal to produce a filtered signal and to apply the filtered signal to the speaker; and a detector module configured to determine a howling frequency in the microphone signal attributable to sound output from the speaker, where the filter module is configured to decrease a magnitude of the filtered signal at the howling frequency.

In further features, the detector module is configured to determine the howling frequency based on a comparison of the filtered signal applied to the speaker at a first time and the microphone signal at a second time that is after the first time.

In further features, the detector module includes a neural network trained to determine howling frequencies and the detector module determines the howling frequency using the neural network.

In further features, the neural network is a deep neural network.

In further features, the filter module includes a notch filter, and the filter module is configured to adjust a notch frequency range of the notch filter such that the howling frequency is within the notch frequency range.

In further features, the filter module includes a notch filter, and the filter module is configured to adjust a notch depth of the notch filter at the howling frequency.

In further features, a power spectral density (PSD) module is configured to determine a PSD based on the microphone signal, and the detector module is configured to determine the howling frequency based on the PSD.

In further features, the PSD module is further configured to determine a second PSD based on the filtered signal, and the detector module is configured to determine the howling frequency further based on the second PSD.

In further features, the detector module includes a neural network trained to determine howling frequencies based on PSDs and the detector module determines the howling frequency using the neural network.

In further features, the neural network is a deep neural network.

In further features, a vehicle includes the audio system and a passenger cabin, where the speaker outputs sound within the passenger cabin, and where the microphone is disposed within the passenger cabin.

In a feature, an audio system includes: a speaker; a microphone that generates a microphone signal based on sound output from the speaker; a mixer module configured to generate a mixed signal by mixing the microphone signal with an audio signal; a canceller module configured to: determine a howling frequency in the microphone signal attributable to sound output from the speaker; generate a resulting signal by decreasing a magnitude of the mixed signal at the howling frequency; and apply the resulting signal to the speaker.

In further features, the canceller module is configured to determine the howling frequency based on a comparison of the resulting signal applied to the speaker at a first time and the microphone signal at a second time that is after the first time.

In further features, the canceller module includes a neural network trained to determine howling frequencies and the canceller module determines the howling frequency using the neural network.

In further features, the neural network is a deep neural network.

In further features, a power spectral density (PSD) module is configured to determine a PSD based on the microphone signal, where the canceller module is configured to determine the howling frequency based on the PSD.

In further features, the PSD module is further configured to determine a second PSD based on the resulting signal, and where the canceller module is configured to determine the howling frequency further based on the second PSD.

In further features, the canceller module includes a neural network trained to determine howling frequencies based on PSDs and the canceller module determines the howling frequency using the neural network.

In further features, the neural network is a deep neural network.

In a feature, a method includes: by a microphone, generating a microphone signal based on sound output from a speaker; generating a mixed signal by mixing the microphone signal with an audio signal; filtering the mixed signal to produce a filtered signal; applying the filtered signal to the speaker; determining a howling frequency in the microphone signal attributable to sound output from the speaker; and decreasing a magnitude of the filtered signal at the howling frequency.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Passengers of a vehicle sit within a passenger cabin of the vehicle. One or more microphones may be disposed within the passenger cabin. One or more speakers may output sound within the passenger cabin. The present application involves systems and methods for minimizing howling. More specifically, systems and methods are described for determining a howling frequency in the signal output by the microphone, such as using a neural network (e.g., a deep neural network) trained to identify howling.

Figure 1:
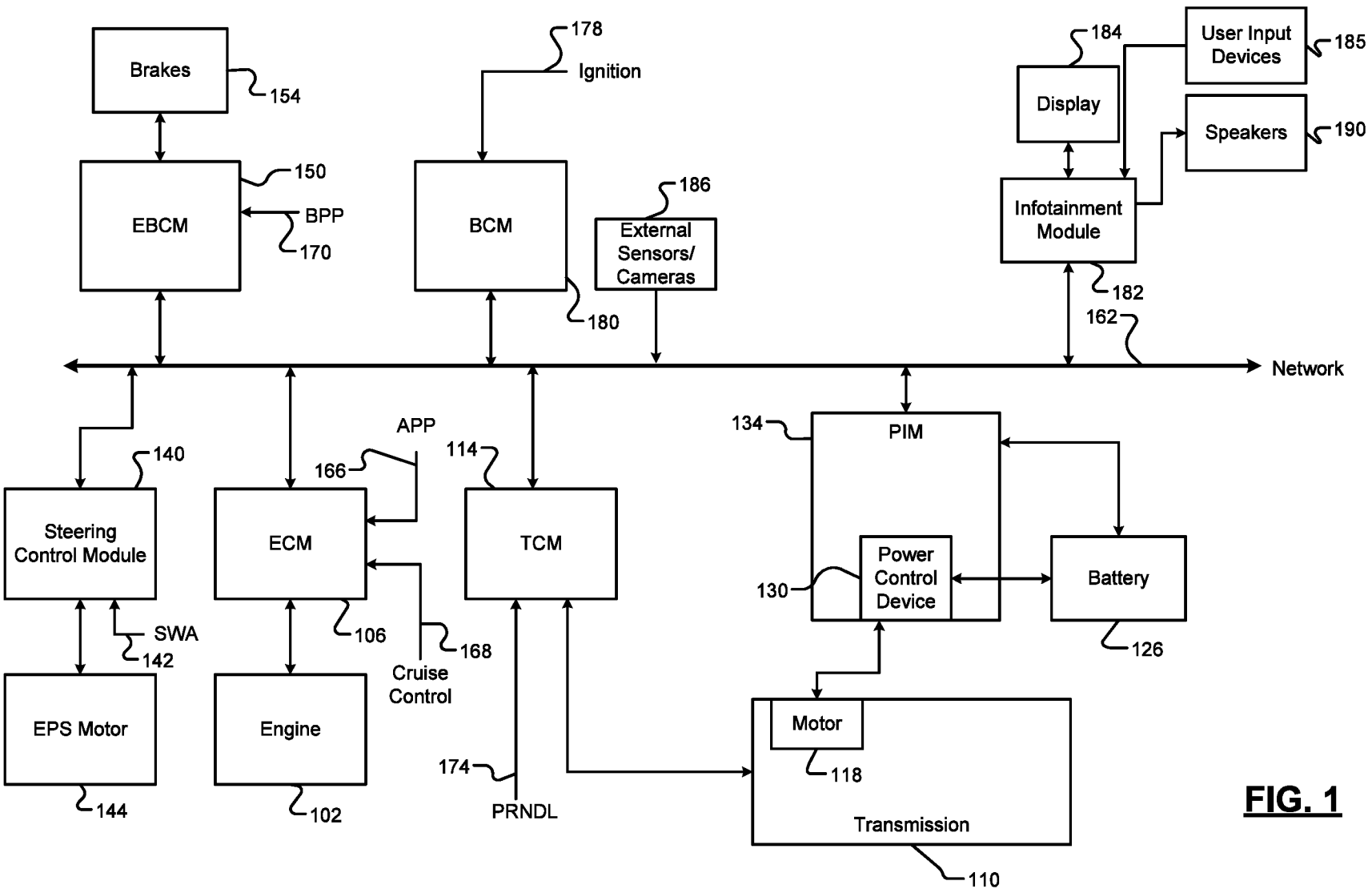
FIG. 1 is a functional block diagram of an example vehicle system.

Referring now to FIG. 1, a functional block diagram of an example vehicle system is presented. While a vehicle system for a hybrid vehicle is shown and will be described, the present disclosure is also applicable to non-hybrid vehicles, electric vehicles, fuel cell vehicles, and other types of vehicles. The present application is applicable to autonomous vehicles, non-autonomous vehicles, semi-autonomous vehicles, and other types of vehicles. Also, while the example of a vehicle audio system is provided, the present application is also applicable to other types of systems that include (a) one or more speakers and (b) one or more microphones that receive sound output by the speakers, such as public announcement (PA) systems, monitors (e.g., baby monitors), concert audio systems, etc.

An engine 102 may combust an air/fuel mixture to generate drive torque. An engine control module (ECM) 106 controls the engine 102 based on one or more driver inputs. For example, the ECM 106 may control actuation of engine actuators, such as a throttle valve, one or more spark plugs, one or more fuel injectors, valve actuators, camshaft phasers, an exhaust gas recirculation (EGR) valve, one or more boost devices, and other suitable engine actuators. In electric vehicles, the engine 102 may be omitted.

The engine 102 may output torque to a transmission 110. A transmission control module (TCM) 114 controls operation of the transmission 110. For example, the TCM 114 may control gear selection within the transmission 110 and one or more torque transfer devices (e.g., a torque converter, one or more clutches, etc.).

The vehicle system may include one or more electric motors. For example, an electric motor 118 may be implemented within the transmission 110 as shown in the example of FIG. 1. An electric motor can act as either a generator or as a motor at a given time. When acting as a generator, an electric motor converts mechanical energy into electrical energy. The electrical energy can be, for example, used to charge a battery 126 via a power control device (PCD) 130. When acting as a motor, an electric motor generates torque that may be used, for example, to supplement or replace torque output by the engine 102. While the example of one electric motor is provided, the vehicle may include zero or more than one electric motor.

A power inverter module (PIM) 134 may control the electric motor 118 and the PCD 130 based on one or more driver inputs. The PCD 130 applies (e.g., direct current) power from the battery 126 to the (e.g., alternating current) electric motor 118 based on signals from the PIM 134, and the PCD 130 provides power output by the electric motor 118, for example, to the battery 126. The PIM 134 may be referred to as an inverter module in various implementations.

A steering control module 140 controls steering/turning of wheels of the vehicle, for example, based on driver turning of a steering wheel within the vehicle and/or steering commands from one or more vehicle control modules. A steering wheel angle sensor (SWA) monitors rotational position of the steering wheel and generates a SWA 142 based on the position of the steering wheel. As an example, the steering control module 140 may control vehicle steering via an EPS motor 144 based on the SWA 142. However, the vehicle may include another type of steering system. An electronic brake control module (EBCM) 150 may selectively control (friction) brakes 154 of the vehicle, for example, based on one or more driver inputs.

Some modules of the vehicle may share parameters via a network 162, such as a controller area network (CAN) or another suitable type of network. A CAN may also be referred to as a car area network. The network 162 may include one or more data buses. Various parameters may be made available by control modules to other control modules via the network 162.

The driver inputs may include, for example, an accelerator pedal position (APP) 166 which may be provided to the ECM 106. A cruise control input 168 may also be input to the ECM 106 from a cruise control system. In various implementations, the cruise control system may include an adaptive cruise control system. A brake pedal position (BPP) 170 may be provided to the EBCM 150. A position 174 of a park, reverse, neutral, drive lever (PRNDL) may be provided to the TCM 114. An ignition state 178 may be provided to a body control module (BCM) 180. For example, the ignition state 178 may be input by a driver via an ignition key, button, or switch. At a given time, the ignition state 178 may be one of off, accessory, run, or crank. While example inputs are provided, the present application is also applicable to other driver inputs. Additionally or alternatively, the modules may utilize one or more other inputs.

The vehicle system may include an infotainment module 182. The infotainment module 182 controls what is displayed on a display 184. The display 184 may be a touchscreen display in various implementations and transmit signals indicative of user input to the display 184 to the infotainment module 182. The infotainment module 182 may additionally or alternatively receive signals indicative of user input from one or more other user input devices 185, such as one or more switches, buttons, knobs, etc. Another type of user input device includes one or more microphones within the passenger cabin.

The infotainment module 182 may receive signals from a plurality of external sensors and cameras, generally illustrated in FIG. 1 by 186. For example, the infotainment module 182 may display video, various views, and/or alerts on the display 184 via input from the external sensors and cameras 186. The external sensors and cameras 186 sense and capture images of the environment around the vehicle.

The infotainment module 182 may also generate output via one or more other devices. For example, the infotainment module 182 may output sound via one or more speakers 190 of the vehicle. The vehicle may include one or more additional control modules that are not shown, such as a chassis control module, a battery pack control module, etc. The vehicle may omit one or more of the modules shown and discussed.

Input from the external sensors and cameras 186 may also be used to control autonomous driving, determining whether to enter into or disable autonomous driving, and/or for one or more other uses.

Figure 2:
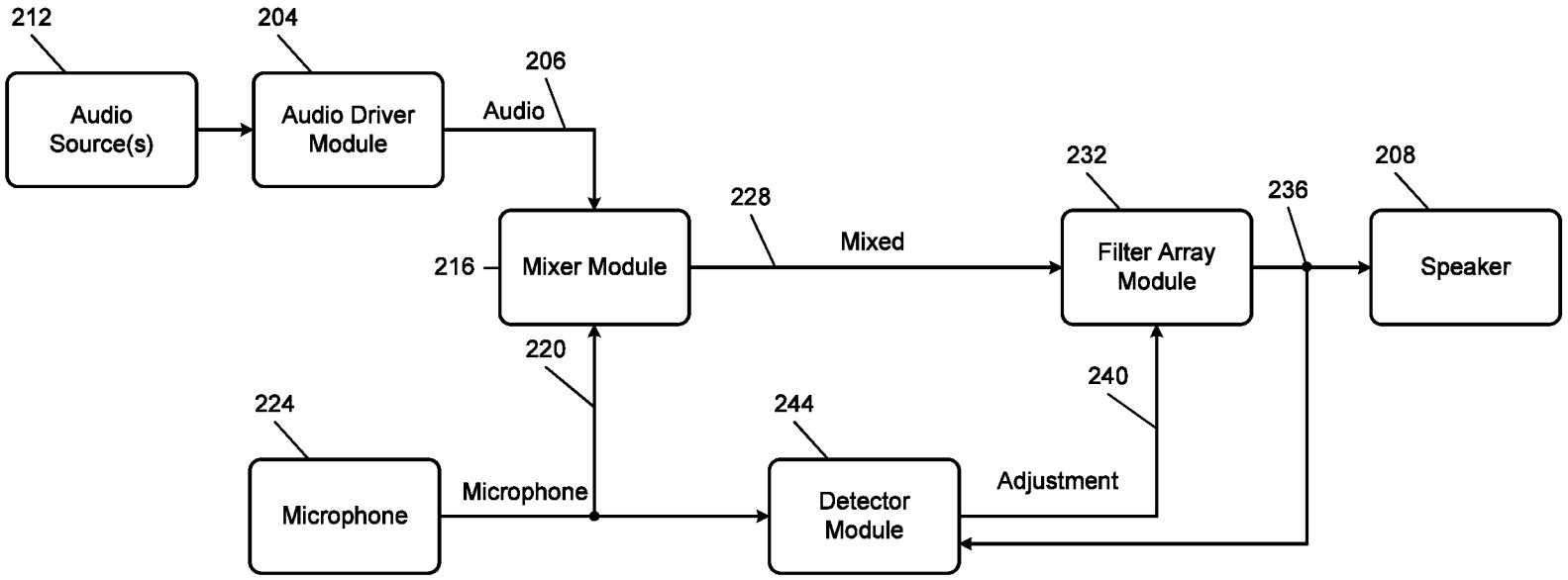
FIGS. 2-4B are functional block diagrams of example audio systems.

FIG. 2 is a functional block diagram of an example audio system. An audio driver module 204 generates audio signals 206 to be output via one or more speakers 208, such as the speakers 190, based on input from one or more audio sources 212. Examples of the audio sources 212 include amplitude modulation (AM) radio sources, frequency modulation (FM) radio sources, satellite radio sources, memory, mobile devices (e.g. cellular phones), other types of computing devices, etc.

A mixer module 216 mixes the audio signals 206 with a microphone signal 220 generated by a microphone 224 to create a mixed signal 228. The mixer module 216 may, for example, sum the audio signals 206 and the microphone signal 220, such as the magnitudes at each frequency. The microphone 224 generates the microphone signal 220 based on sound at the microphone 224. The microphone 224 and the speaker(s) 208 are disposed such that the microphone 224 generates the microphone signal 220 based on sound output from the speaker(s) 208.

A filter array module 232 filters the mixed signal 228 to produce a filtered signal 236, and applies the filtered signal 236 to the speaker(s) 208. In this manner, the speaker(s) 208 output sound based on the filtered signal 236. The filter array module 232 may include a notch filter or another suitable type of filter configured to cancel, decrease, block, or otherwise remove one or more frequencies in the mixed signal 228 before the filtered signal 236 is output.

The filter array module 232 adjusts the filter (e.g., the frequency band of the notch) based in an adjustment 240. A detector module 244 is trained to detect one or more frequencies where howling is present and to generate the adjustment 240 based on the howling frequency(s). The detector module 244 may detect the one or more frequencies, for example, based on the present microphone signal 220 and the filtered signal 236 from a predetermined period before the present time. The use of the present microphone signal 220 and the filtered signal 236 from the predetermined period earlier may be attributable to the time delay between (a) a first time of sound being output by the speaker(s) 208 and (b) a second time after the first time when the microphone 224 generates the microphone signal 220 to include that sound output by the speaker(s) 208.

The detector module 244 may include, for example, a neural network, a deep neural network (DNN), a convolutional neural network (CNN), or another suitable type of neural network trained to detect howling. Howling frequencies may be, for example, frequencies where the microphone signal 220 generated by the microphone 224 based on sound output from the speaker(s) 208. For example, when the filtered signal 236 from the predetermined period earlier has a magnitude of X at a frequency Y and the present microphone signal 220 includes a magnitude of near X (e.g., X+/−20 percent or another suitable value) near or at the frequency Y and X is greater than a predetermined magnitude (e.g., 10 decibels or another suitable magnitude), the detector module 244 may identify the frequency Y as a howling frequency.

In various implementations, the filter array module 232 may also adjust a notch depth of the notch filter. The notch depth may indicate how much attenuation is to be performed at a detected howling frequency. The filter array module 232 may adjust the notch depth, for example, based on the magnitude to be greater than or equal to the magnitude of the mixed signal 228 at the detected howling frequency. This may ensure sufficient attenuation at the detected howling frequency.

Figure 3:
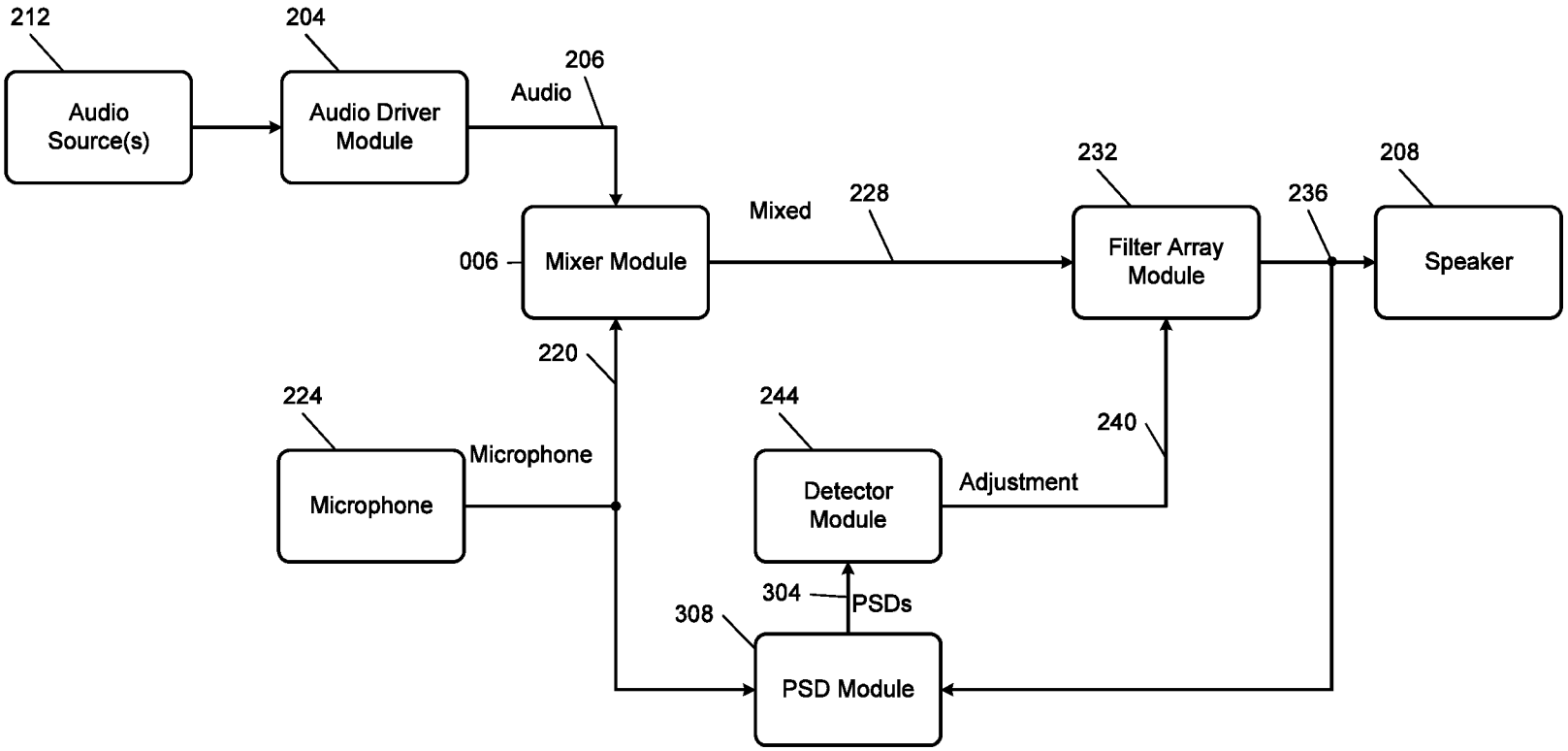

FIG. 3 is a functional block diagram of an audio system. In the example of FIG. 3, the detector module 244 is trained to detect the howling frequency(s) based on power spectral densities (PSDs) 304. The PSDs 304 may include a predicted PSD and a present PSD. The detector module 244 may include, for example, DNN trained to detect howling based on PSDs.

A PSD module 308 is trained to generate the PSDs. The PSD module 308 may generate the predicted PSD, for example, based on the filtered signal 236 from the predetermined period earlier and the present microphone signal 220. The PSD module 308 may generate the present PSD, for example, based on the present microphone signal 220 and the microphone signal 220 from the predetermined period earlier (i.e., before the present time). As an example, when the predicted PSD has a magnitude of M at a frequency N and the present PSD includes a magnitude of near M (e.g., M+/−20 percent or another suitable value) near or at the frequency N and M is greater than a predetermined magnitude (e.g., 10 decibels or another suitable magnitude), the detector module 244 may identify the frequency N as a howling frequency. The detector module 244 generates the adjustment 240 based on the howling frequency(s).

As discussed above, filter array module 232 adjusts the filter (e.g., the frequency band of a notch) based in the adjustment 240 to cancel, minimize, block, or otherwise decrease howling at the howling frequency(s).

Figure 4A:
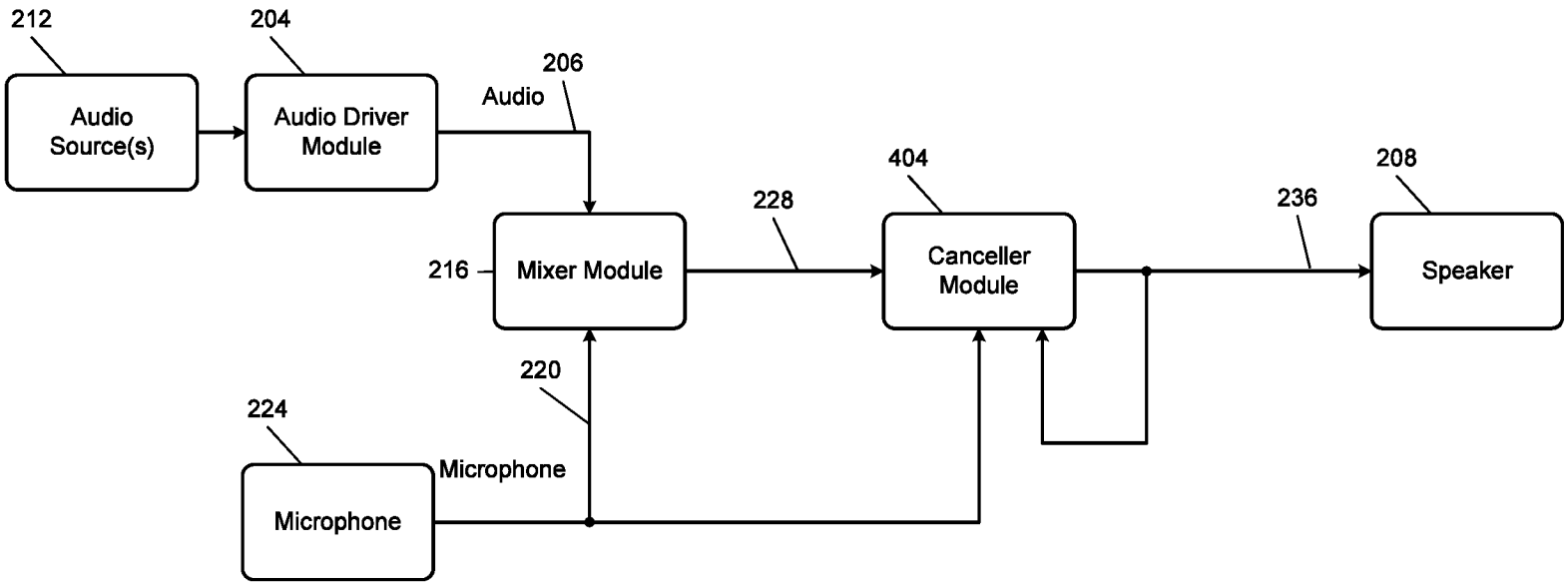

FIG. 4A is a functional block diagram of an audio system. In the example of FIG. 4A, a canceller module 404 receives the mixed signal 228. The canceller module 404 is trained to detect howling frequencies. The canceller module 404 may include, for example, a DNN trained to detect howling frequencies. The canceller module 440 blocks or cancels the mixed signal 228 at the detected howling frequencies. Blocking and cancelling may cause the filtered signal 236 to have magnitudes of zero decibels or near zero (e.g., less than 5 decibels) at the howling frequency(s). The canceller module 440 may block or cancel frequencies of the mixed signal 228, for example, by injecting a signal with an equal magnitude but opposite polarity at the howling frequencies.

Figure 4B:
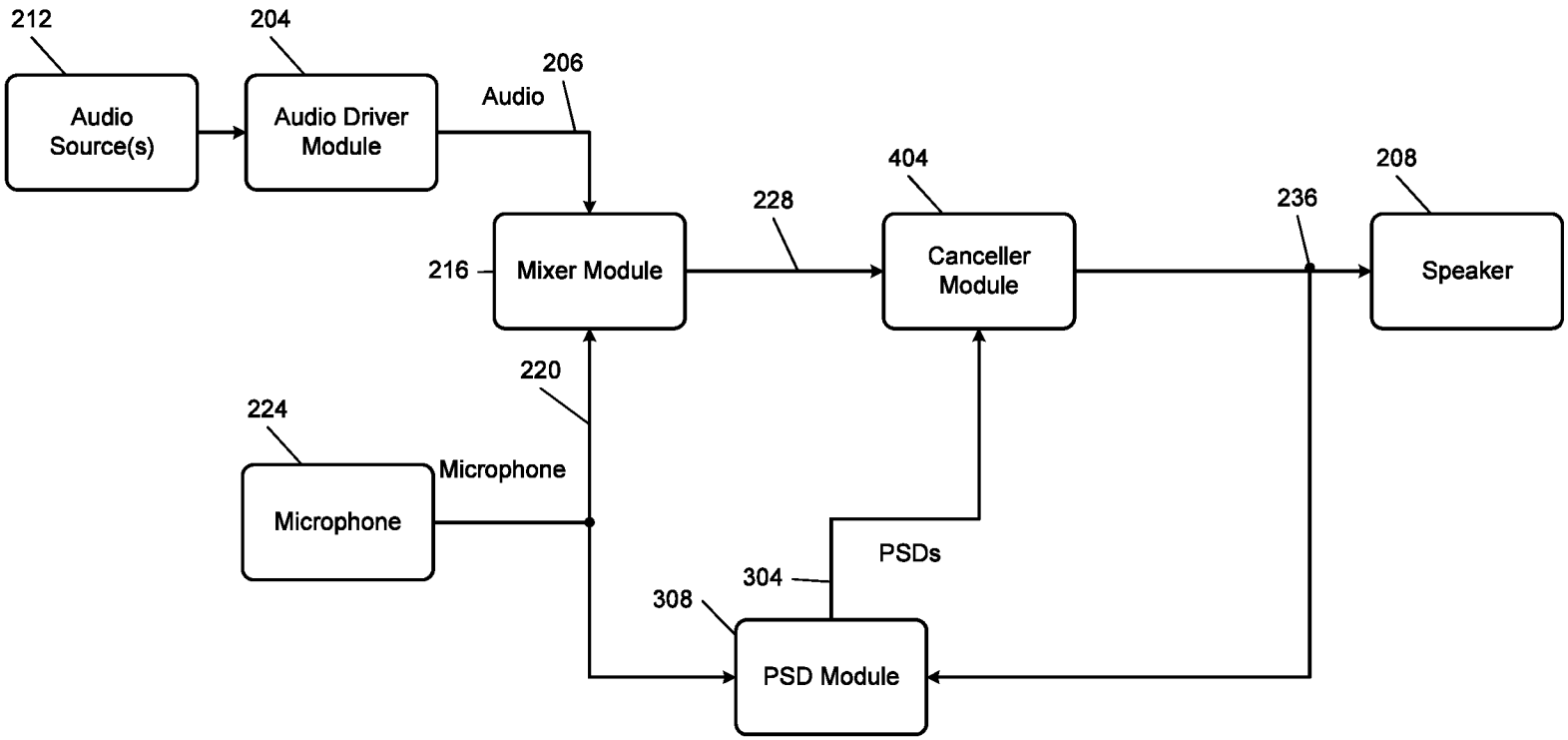

In various implementations, such as in the example of FIG. 4B, the canceller module 404 cancels the howling frequency(s) based on the PSDs 304, as discussed above with respect to FIG. 3. The PSDs 304 may include a predicted PSD and a present PSD. The canceller module 304 may include, for example, DNN trained to detect howling based on PSDs.

As an example, when the predicted PSD has a magnitude of M at a frequency N and the present PSD includes a magnitude of near M (e.g., M+/−20 percent or another suitable value) near or at the frequency N and M is greater than a predetermined magnitude (e.g., 10 decibels or another suitable magnitude), the canceller module 304 may identify the frequency N as a howling frequency. The canceller module 440 blocks or cancels the mixed signal 228 at the detected howling frequencies. Blocking and cancelling may cause the filtered signal 236 to have magnitudes of zero decibels or near zero (e.g., less than 5 decibels) at the howling frequency(s). The canceller module 440 may block or cancel frequencies of the mixed signal 228, for example, by injecting a signal with an equal magnitude but opposite polarity at the howling frequencies.

Figure 5:
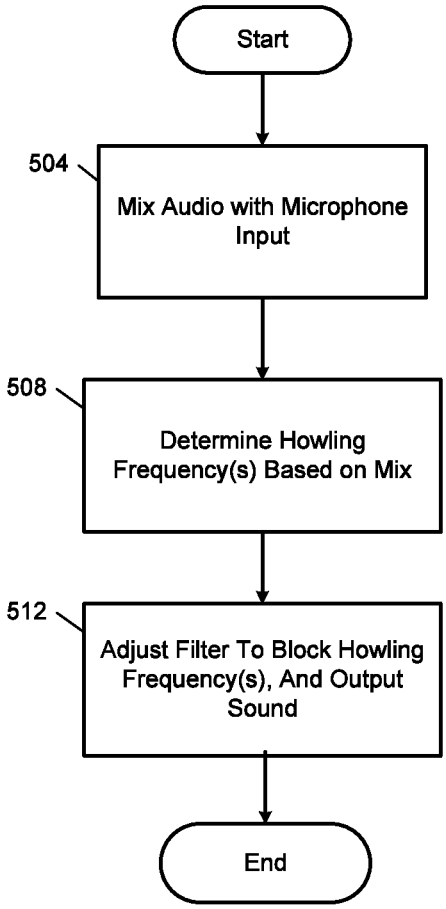
FIGS. 5-7 are flowcharts depicting example methods of minimizing howling.

FIG. 5 is a flowchart depicting an example method of minimizing howling. Control begins with 504 where the mixer module 216 mixes the audio signal 206 with the microphone signal 220. At 508, the detector module 244 determines whether one or more howling frequencies are present in microphone signal 220 based on the previous filtered signal 236 and the microphone signal 220, as discussed above. At 512, the filter array module 232 adjusts the filter to minimize, block (e.g., not pass), cancel, or otherwise minimize the magnitude of the mixed signal 228 at the howling frequency(s) to produce the filtered signal 236. The filter array module 232 applies the filtered signal 236 to the speaker(s) 208 to output sound.

Figure 6:
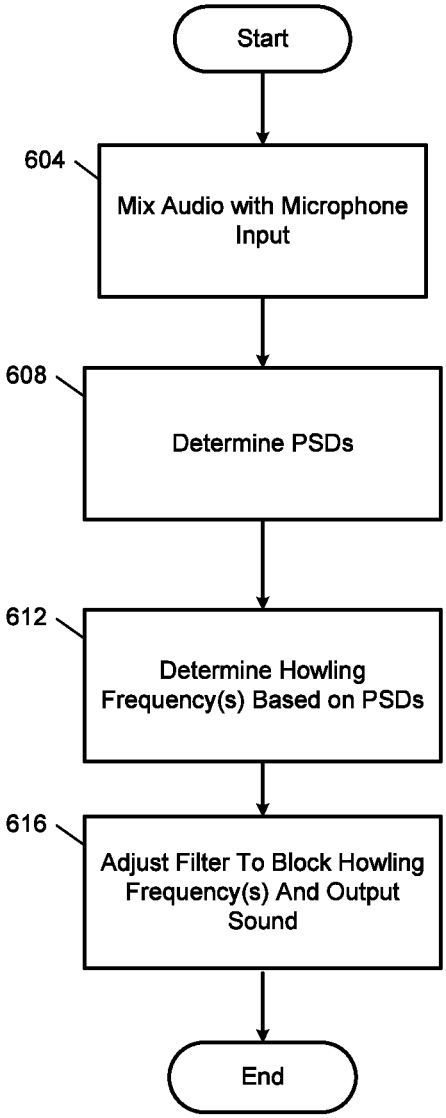

FIG. 6 is a flowchart depicting an example method of minimizing howling. Control begins with 604 where the mixer module 216 mixes the audio signal 206 with the microphone signal 220. At 608, the PSD module 308 determines the PSDs 304 as described above.

At 612, the detector module 244 determines whether one or more howling frequencies are present in microphone signal 220 based on the PSDs 304, as discussed above. At 616, the filter array module 232 adjusts the filter to minimize, block (e.g., not pass), cancel, or otherwise minimize the magnitude of the mixed signal 228 at the howling frequency(s) to produce the filtered signal 236. The filter array module 232 applies the filtered signal 236 to the speaker(s) 208 to output sound.

Figure 7:
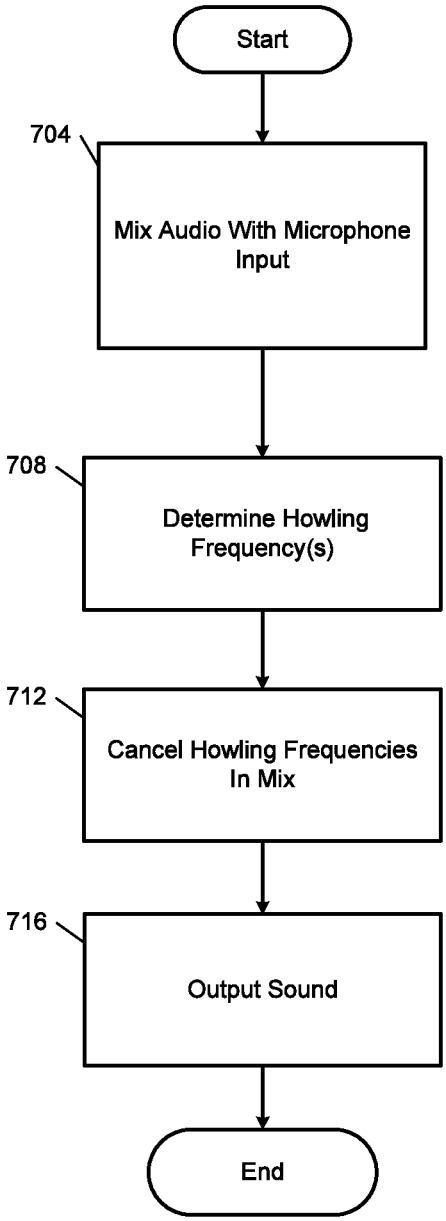

FIG. 7 is a flowchart depicting an example method of minimizing howling. Control begins with 704 where the mixer module 216 mixes the audio signal 206 with the microphone signal 220. At 708, the canceller module 404 determines the howling frequency(s), as discussed above, such as in the examples of FIGS. 4A and 4B.

At 712, the canceller module 404 cancels the howling frequency(s) in the mixed signal 228, as discussed above. At 716, the canceller module 404 applies the filtered signal 236 (with the howling frequencies cancelled) to the speaker(s) 208 to output sound.

Figure 8:
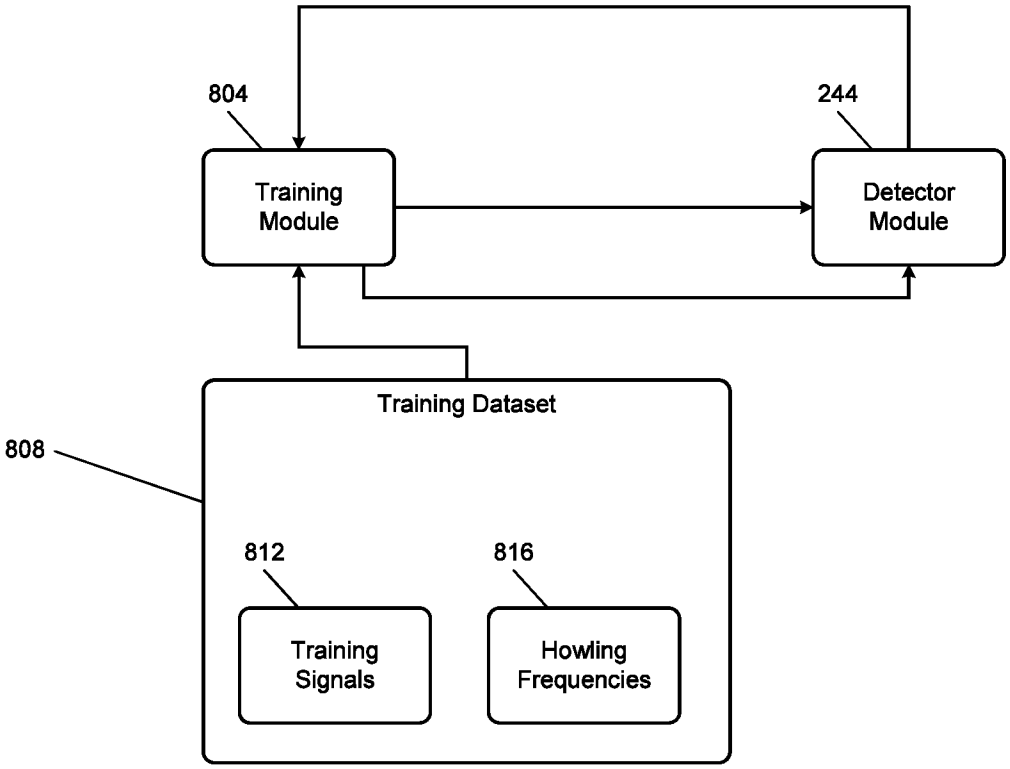
FIGS. 8-10 are example training systems.

FIG. 8 is a functional block diagram of an example training system. A training module 804 trains the detector module 244 (of FIG. 2) to determine the howling frequency(s). The training module 804 trains the detector module 244 using a training dataset 808.

The training dataset 808 includes training signals 812 (e.g., filtered signals applied, microphone signals) and known howling frequencies 816 in the training signals 812, respectively. The training module 804 inputs ones of the training signals 812 to the detector module 244. The training module 804 may input ones the training signals 812, for example, in a random order.

The detector module 244 determines the howling frequency(s) for each of the training signals 812 based on those training signals. For example, based on one set of the training signals 812 (e.g., a filtered signal and a microphone signal), the detector module 244 determines the howling frequency(s) as described above. The detector module 244 does this for each set of training signals input.

Based on the know howling frequency(s) for a set of the training signals 812 and the howling frequency(s) determined by the detector module 244 for that set of the training signals 812, the training module 804 adjusts one or more parameters of the detector module 244 that is/are used to determine the howling frequency(s) in sets of input signals. For example, the training module 804 may adjust the one or more parameters of the detector module 244 in an effort to cause the determined howling frequency(s) to be the same as the known howling frequency(s) for a set of training signals. This trains the detector module 244 to be able to accurately determine the howling frequency(s) given inputs.

Figure 9:
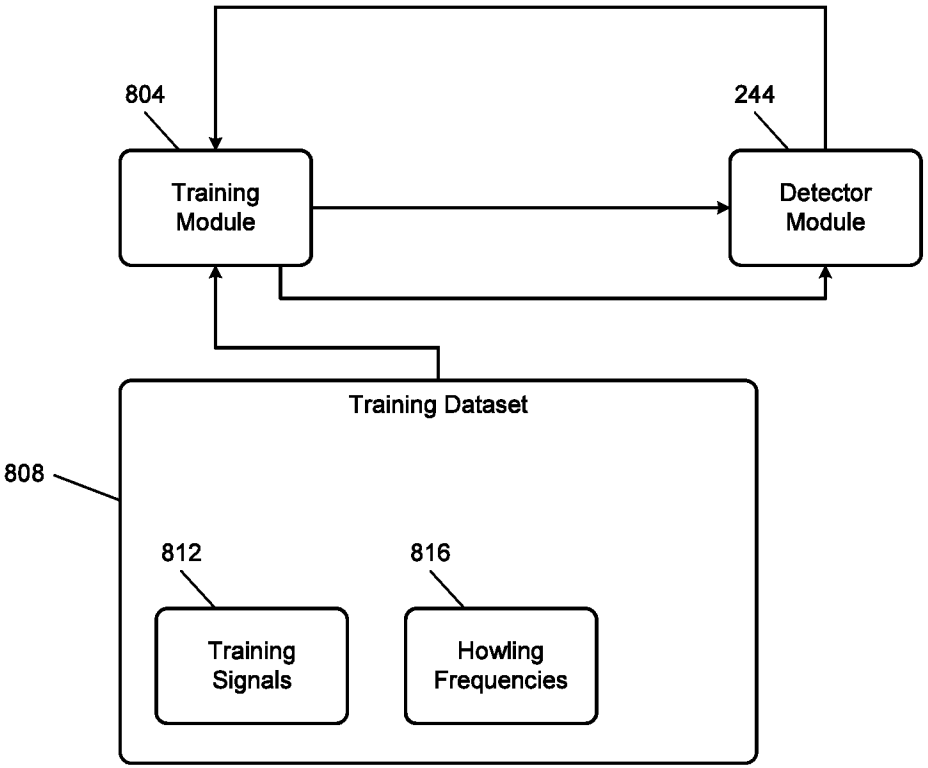

FIG. 9 is a functional block diagram of an example training system. In the example of FIG. 9, the training module 804 trains the detector module 244 (of FIG. 3) to determine the howling frequency(s). In the example of FIG. 9, the training signals 812 include PSDs, and the detector module 244 detects the howling frequency(s) based on the PSDs as discussed above. The training module 804 trains the detector module 244 to minimize differences between the howling frequency(s) determined by the detector module 244 based on input PSDs and the associated known howling frequency(s).

Figure 10:
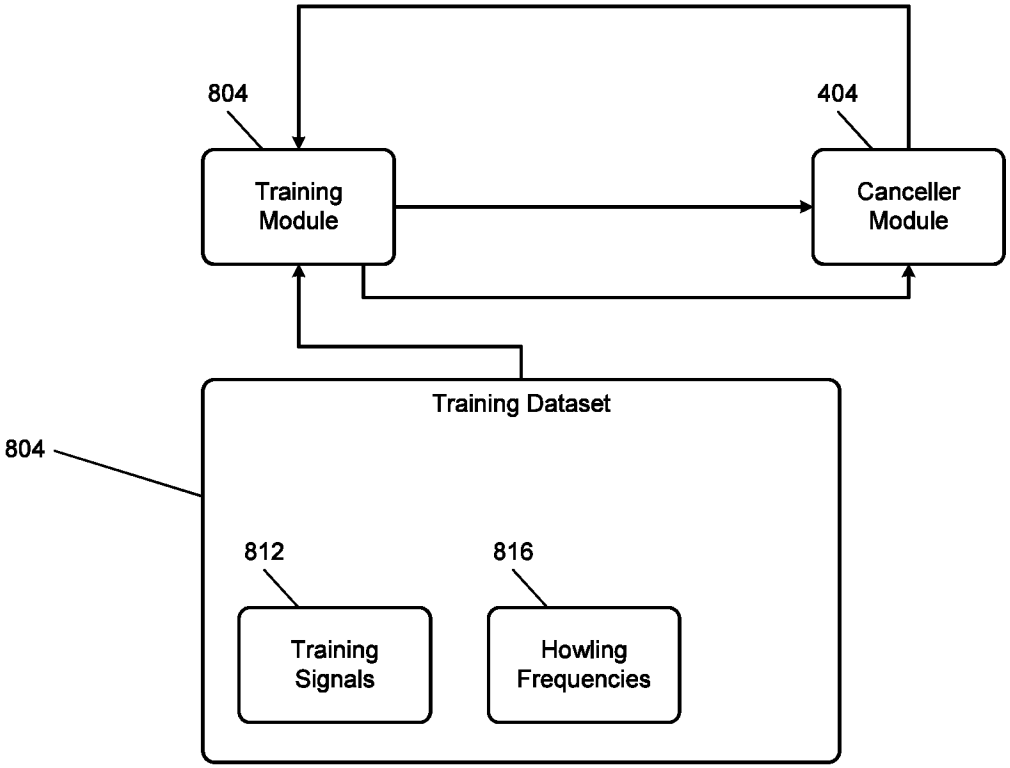

FIG. 10 is a functional block diagram of an example training system. In the example of FIG. 10, the training module 804 trains the canceller module 404 (of FIG. 4) to determine the howling frequency(s) as discussed above in conjunction with the example of FIG. 8. The training module 804 trains the canceller module 404 to minimize differences between the howling frequency(s) determined by the canceller module 404 based on input training signals and the associated known howling frequency(s).

Figure 11:
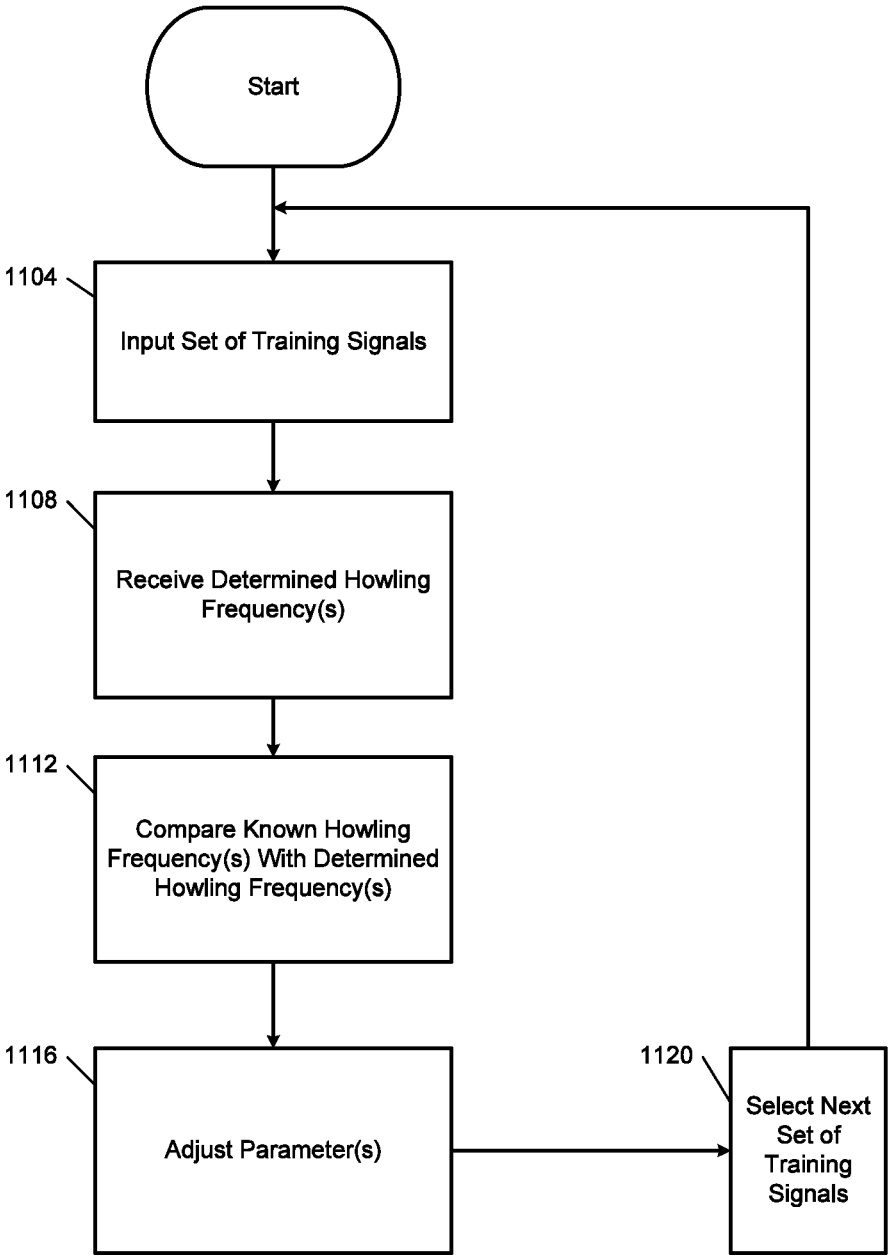
FIG. 11 is a flowchart depicting an example training method.

FIG. 11 is a flowchart depicting an example training method. Control begins with 1104 where the training module 804 selects a set of training signals. One or more howling frequency(s) are associated with the set of training signals. The training module 804 inputs the set of training signals to the detector module 244 or the canceller module 404. The detector module 244 or the canceller module 404 determines the howling frequency(s) based on the set of training signals as discussed above.

At 1108, the training module 804 receives the determined howling frequency(s) from the detector module 244 or the canceller module 404. At 1112, the training module 804 compares the determined howling frequency(s) with the known howling frequency(s) associated with the set of training signals.

At 1116, the training module 804 selectively adjusts one or more parameters of the detector module 244 or the canceller module 404 based on the comparison of the determined howling frequency(s) and the known howling frequency(s). At 1120, the training module 804 selects another set of training signals, and control returns to 1104. In various implementations, a predetermined number of training signals may be input before the training module 804 adjusts the detector module 244 or the canceller module 404 at 1116. While FIG. 11 is shown as returning to 1104, the training may end when a predetermined number of training samples have been input and used for the training.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C #, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. An audio system comprising:

a speaker;

a microphone that generates a microphone signal based on sound output from the speaker;

a mixer module configured to generate a mixed signal by mixing the microphone signal with an audio signal;

a filter module configured to filter the mixed signal to produce a filtered signal and to apply the filtered signal to the speaker; and a detector module configured to determine a howling frequency in the microphone signal attributable to sound output from the speaker, wherein the filter module is configured to decrease a magnitude of the mixed signal at the howling frequency, and wherein the detector module is configured to determine the howling frequency based on a comparison of the filtered signal applied to the speaker at a first time and the microphone signal at a second time that is after the first time.

2. The audio system of claim 1 wherein the detector module includes a neural network trained to determine howling frequencies and the detector module determines the howling frequency using the neural network.

3. The audio system of claim 2 wherein the neural network is a deep neural network.

4. The audio system of claim 1 wherein the filter module includes a notch filter, and the filter module is configured to adjust a notch frequency range of the notch filter such that the howling frequency is within the notch frequency range.

5. The audio system of claim 1 wherein the filter module includes a notch filter, and the filter module is configured to adjust a notch depth of the notch filter at the howling frequency.

6. An audio system comprising:

a speaker;

a microphone that generates a microphone signal based on sound output from the speaker;

a mixer module configured to generate a mixed signal by mixing the microphone signal with an audio signal;

a filter module configured to filter the mixed signal to produce a filtered signal and to apply the filtered signal to the speaker;

a detector module configured to determine a howling frequency in the microphone signal attributable to sound output from the speaker, wherein the filter module is configured to decrease a magnitude of the mixed signal at the howling frequency; and a power spectral density (PSD) module configured to determine a PSD based on the microphone signal, wherein the detector module is configured to determine the howling frequency based on the PSD.

7. The audio system of claim 6 wherein the PSD module is further configured to determine a second PSD based on the filtered signal, and wherein the detector module is configured to determine the howling frequency further based on the second PSD.

8. The audio system of claim 7 wherein the detector module includes a neural network trained to determine howling frequencies based on PSDs and the detector module determines the howling frequency using the neural network.

9. The audio system of claim 8 wherein the neural network is a deep neural network.

10. A vehicle comprising:

the audio system of claim 1; and a passenger cabin, wherein the speaker outputs sound within the passenger cabin, and wherein the microphone is disposed within the passenger cabin.

11. A method comprising:

by a microphone, generating a microphone signal based on sound output from a speaker;

generating a mixed signal by mixing the microphone signal with an audio signal;

filtering the mixed signal to produce a filtered signal;

applying the filtered signal to the speaker; and determining a howling frequency in the microphone signal attributable to sound output from the speaker, wherein determining the howling frequency includes determining the howling frequency based on a comparison of the filtered signal applied to the speaker at a first time and the microphone signal at a second time that is after the first time; and decreasing a magnitude of the mixed signal at the howling frequency.

12. The method of claim 11 wherein determining the howling frequency includes determining the howling frequency using a neural network trained to determine howling frequencies.

13. The method of claim 11 wherein the filtering includes applying a notch filter and adjusting a notch frequency range of the notch filter such that the howling frequency is within the notch frequency range.

14. The method of claim 11 wherein the filtering includes applying a notch filter and adjusting a notch depth of the notch filter at the howling frequency.

15. The method of claim 11 further comprising:

determining a power spectral density (PSD) module based on the microphone signal; and determining the howling frequency further based on the PSD.

16. The method of claim 15 further comprising:

determining a second PSD based on the filtered signal; and determining the howling frequency further based on the second PSD.

17. The method of claim 16 wherein determining the howling frequency includes determining the howling frequency using a neural network trained to determine howling frequencies based on PSDs.

18. The method of claim 17 wherein the neural network is a deep neural network.

* * * * *